US006953171B2

(12) United States Patent
Takashima

(10) Patent No.: US 6,953,171 B2
(45) Date of Patent: Oct. 11, 2005

(54) APPARATUS FOR AUTOMATICALLY PAYING OUT FREE END PORTION OF ROLLED PAPER

(75) Inventor: Yoshikazu Takashima, Toyama (JP)

(73) Assignee: Nisseitechnica Co., Ltd., Toyama (JP)

( * ) Notice: Subject to any disclaimer, the term of this patent is extended or adjusted under 35 U.S.C. 154(b) by 0 days.

(21) Appl. No.: 10/218,539

(22) Filed: Aug. 14, 2002

(65) Prior Publication Data

US 2003/0041716 A1 Mar. 6, 2003

(30) Foreign Application Priority Data

Sep. 5, 2001 (JP) ..... 2001-268674

(51) Int. Cl.[7] ..... A47K 10/36; A47K 10/38

(52) U.S. Cl. ..... 242/564.4; 83/167; 83/649; 83/694; 242/598.3

(58) Field of Search ..... 83/86, 694, 203, 83/209, 650, 436.5, 436.55, 949, 698.11, 78, 167, 649; 242/563.2, 564.1, 564.4, 598.3, 598.4, 599

(56) References Cited

U.S. PATENT DOCUMENTS

| | | | | | |
|---|---|---|---|---|---|
| 1,310,019 | A | * | 7/1919 | Hosfeldt | 225/14 |
| 1,379,164 | A | * | 5/1921 | Bullis | 242/594.6 |
| 3,301,617 | A | * | 1/1967 | Goodwin et al. | 242/564.4 |
| 3,737,087 | A | * | 6/1973 | Rooklyn | 226/110 |
| 3,896,691 | A | * | 7/1975 | Granger et al. | 83/335 |
| 4,473,430 | A | * | 9/1984 | Voltmer et al. | 156/504 |
| 5,131,302 | A | * | 7/1992 | Watanabe | 83/62 |
| 5,452,832 | A | * | 9/1995 | Niada | 225/11 |
| 5,857,393 | A | * | 1/1999 | Kohiyama | 83/76.1 |
| 5,937,723 | A | * | 8/1999 | Kirikoshi et al. | 83/614 |
| 6,113,293 | A | * | 9/2000 | Schanke et al. | 400/621 |

FOREIGN PATENT DOCUMENTS

| | | | |
|---|---|---|---|
| EP | 0 412 169 | A | 2/1991 |
| JP | 62 074324 | A | 4/1987 |
| JP | 02 295526 | A | 12/1990 |
| JP | 2000-287872 | A | 10/2000 |
| WO | WO 00 60990 | A | 10/2000 |

* cited by examiner

*Primary Examiner*—Kathy Matecki
*Assistant Examiner*—Scott Haugland
(74) *Attorney, Agent, or Firm*—Frishauf, Holtz, Goodman & Chick, P.C.

(57) ABSTRACT

A roll shaft 26 supporting rolled paper 20, such as toilet paper rotatably thereon, a pair of feed rollers 32, 34 for paying out the free end portion of the rolled paper 20 which has been paid out continuously from the rolled paper 20, and a driving unit for rotating the feed rollers 34 are provided. A pay-out rate control unit for automatically controlling the portion of the rolled paper 20 which has been paid out to a position beyond the two feed rollers 32, 34, in such a manner that the paid-out portion of the rolled paper 20 is further paid out by a length at a time corresponding to that of one unit of use thereof is included. A cutter 50 for automatically cutting the portion of the rolled paper which has been paid out from the feed rollers 32, 34, to a length corresponding to that of one unit of use thereof, a paper receiver 22 for folding the cut portion of the rolled paper into cross-sectionally zigzag state by utilizing the weight of the paper itself, and a paper receiver width regulating members 22*b* for regulating the width of folds of the paper folded by the paper receiver 22 are provided.

2 Claims, 4 Drawing Sheets

APPARATUS FOR AUTOMATICALLY PAYING OUT FREE END PORTION OF ROLLED PAPER

BACKGROUND OF THE INVENTION

This invention relates to an apparatus for automatically paying out a free end portion of rolled paper, adapted to automatically pay out a free end portion of rolled paper, such as toilet paper, kitchen paper, paper towel and the like, and cut off the paid-out portion of the same.

RELATED ART

In a related art rolled paper holder having, for example, an apparatus for paying out a free end portion of toilet paper, a paper portion of a predetermined length is paid out from the rolled paper by a motor-driven feed rollers, folded by a paper receiver, and cut off with a cutter as disclosed in JP-A-287872/2000 filed by the applicant of the present invention.

In the case of these related techniques, a free end paper portion paid out from the rolled paper is folded to a predetermined width by the paper receiver but it was impossible to regulate, i.e., increase or decrease the width of the folded paper portion as occasion demands. Moreover, when a blade of the cutter became blunt, it was necessary to disassemble a part of the apparatus and renew the blade, and such operations were troublesome.

The present invention has been made in view of these problems encountered in the related techniques, and provides an apparatus for automatically paying out a free end portion of rolled paper, capable of suitably paying out a free end portion of a necessary length of the rolled paper and putting the paid-out portion of the rolled paper in a folded state, and adapted to be handled simply.

SUMMARY OF THE INVENTION

The present invention relates to an apparatus for automatically paying out a free end portion of rolled paper, provided with a roll shaft which supports rolled paper, such as toilet paper rotatably thereon, a pair of feed rollers for paying out the free end portion of the rolled paper which is fed continuously from the rolled paper, a driving unit for rotating these feed rollers, and a pay-out rate control unit for automatically controlling the portion of the rolled paper which has been paid out to a position beyond the two feed rollers, in such a manner that the paid-out portion of the rolled paper is further paid out by a quantity at a time corresponding to that of one unit of use thereof, for example, by a length of several folds of the paid-out portion of the rolled paper. The apparatus for automatically paying out a free end portion of rolled paper is further provided with a cutter for automatically cutting the portion of the rolled paper which has been paid out from the feed rollers, to a length corresponding to that of one unit of use thereof, a paper receiver for folding the cut portion of the rolled paper into cross-sectionally zigzag state by utilizing the weight of the paper itself, and a paper receiver width regulating members for regulating the width of folds of the paper folded by the paper receiver.

The roll shaft mentioned above is provided with flanges, and inclined portions, the diameter of which varies continuously, between these flanges and a side surface of the roll shaft. The cutter is formed by providing the interior of a box type cartridge with a paper cutting blade, and this cartridge is provided so as to be combined with a driving unit, which is adapted to drive the blade in the cartridge, in one body therewith and detachably therefrom. On one side of the cartridge, an extrusion member, such as a lever adapted to be turned, etc. around a pivot and extrude the cartridge is provided. A slip preventing member, such as an O-ring is fitted around one of the feed rollers, and this slip preventing member contacts the other feed roller.

MODE FOR CARRYING OUT THE INVENTION

Figure 1:
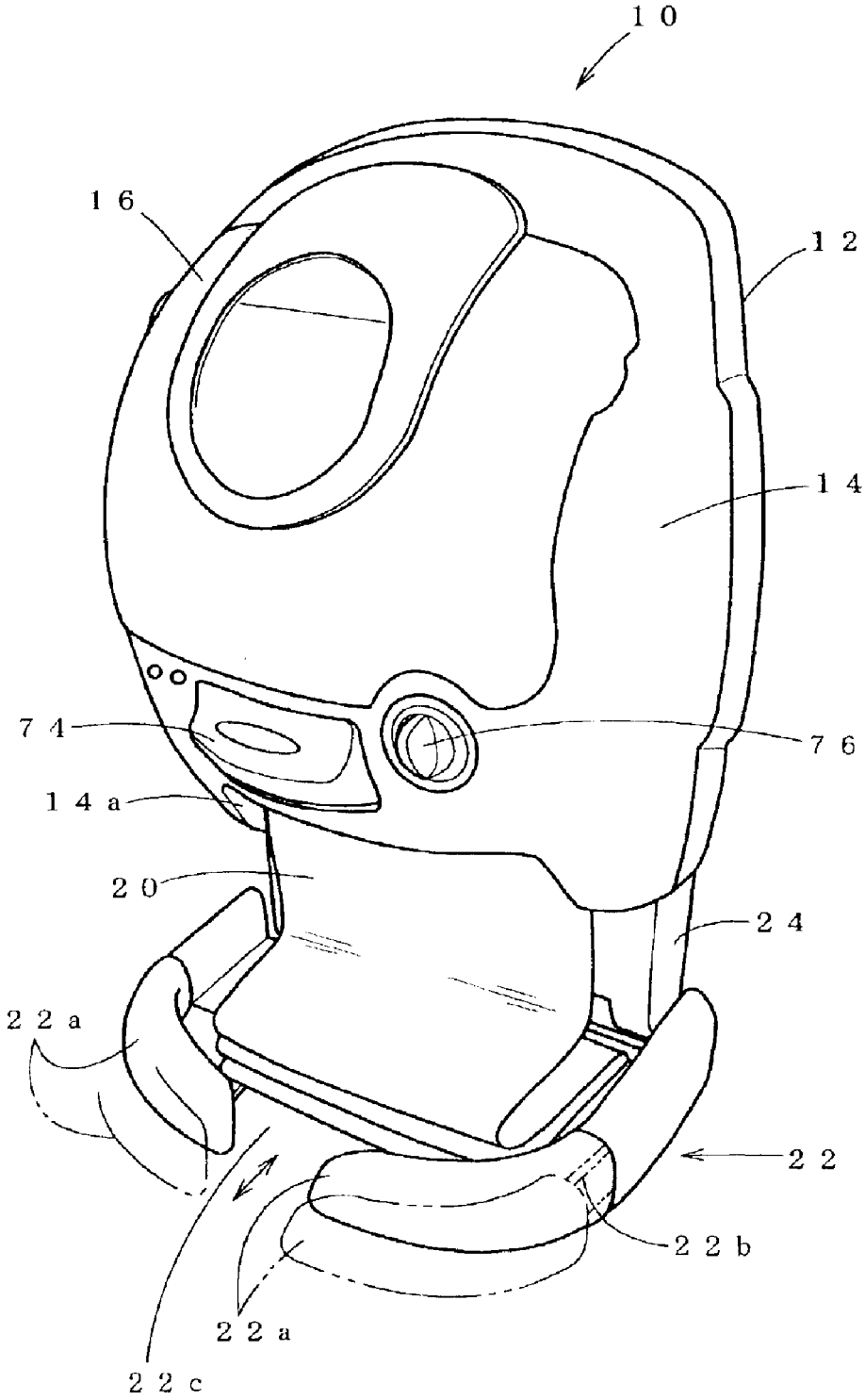
FIG. 1 is a perspective view showing an outer appearance of a mode of embodiment of the apparatus for automatically paying out a free end portion of rolled paper according to the present invention.

A mode of embodiment of the present invention will now be described on the basis of what are shown in the drawings. FIG. 1 to FIG. 4 show a rough construction of a mode of embodiment of the apparatus as a whole for automatically paying out a free end portion of rolled paper. This mode of embodiment of the apparatus 10 for automatically paying out a free end portion of rolled paper is provided with an armor-forming rear plate 12, a housing 14 provided detachably with respect to this rear plate 12 and formed so as to bulge out forward, and a cover 16 provided at a part of a front portion of this housing 14 so that the cover can be pivotally opened and closed. An opening 14*a* is provided in a lower portion of the housing 14, while a paper receiver 22, which is adapted to receive a paid-out portion of rolled paper 20, such as toilet paper just under feed rolls, is provided at a lower portion of the rear plate 12. The rear plate 12 and paper receiver 22 are provided so that they are spaced from each other by a predetermined distance via a joint portion 24.

The paper receiver 22 is positioned at substantially right angles to the joint portion 24, and front walls 22*a* of the paper receiver 22 have a height large enough for the paid-out portion of the rolled paper 20 to contact the same. Moreover, a distance between the joint portion 24 and front walls 22*a* of the paper receiver 22 is regulated by the front walls 22*a* provided forwardly slidably along a longitudinal direction of movable guide members 22*b* which constitute paper receiver width regulating members. The front walls 22*a* are distally disposed to provide an opened portion 22*c* therebetween to enable a user to easily obtain the paper.

The housing 14 is provided with a pair of brackets (not shown) in an upper portion of the interior thereof. Between the brackets, rolled paper 20, such as toilet paper is supported detachably and rotatably via a roll shaft 26 passed through a shaft inserting hole of the rolled paper 20. The roll shaft 26 is provided with flanges 28 the diameter of which is substantially equal to that of the shaft inserting hole of the rolled paper 20. Inclined portions 30 the diameter of which varies continuously are provided between the flanges 28 and a side surface of the roll shaft 26. The inclined portions 30 may have a truncated-conical shape as well as a curved shape as shown in the drawing.

In the portion of the interior of the housing 14 which is below the roll shaft 26, a plurality of pairs of feed rollers 32, 34 for paying out a free end portion of the roll paper 20 are provided. To one feed roller 34, a driving motor 35 for rotating the feed roller 34 is connected via a driving mechanism (not shown). The feed roller 34 is mounted fixedly on a rotary shaft 39, and one groove is formed in a central portion of an outer circumferential surface of the feed roller 34 so that the groove extends fully in the circumferential direction thereof, an O-ring 36 being fitted in this groove. The driving mechanism and driving motor 35 are housed in a case 38 for a driving unit. The feed roller 32 is mounted fixedly on a rotary shaft 40, which is supported rotatably on bearing portions 41, 42 of the case 38 via bearings 45, 46. Each of the bearing portions 41, 42 is provided with an arched elongated hole 44, and a lever 48 is provided on the bearing 46 of the bearing portion 42 so as to be integral therewith. The lever 48 is provided so that, when the lever 48 is turned, the feed roller 32 is turned with the rotary shaft 40 to enable a clearance to be formed between the feed roller 32 and the opposed feed roller 34. It is recommended that a locking mechanism be provided which is capable of temporarily locking the lever 48 or rotary shaft 39 and the like with the feed roller 32 turned to form a clearance between the feed roller 32 and the opposed feed roller 34. Owing to this locking mechanism, an operation for inserting a paid-out portion of the rolled paper 20 between the feed rolls becomes safer.

The feed roller 34 or the driving mechanism is provided with a detector adapted to detect a pay-out rate of the free end portion of the rolled paper 20 on the basis of a rotational frequency of the feed rollers. The detector is formed by a device for detecting the number of ON-OFF actions of a limit switch, a device utilizing an optical sensor or a proximity sensor, and a device including various kinds of rotary encoders and the like. The detector is connected to a control unit 18. The control unit 18 is adapted to compare a pay-out rate setting counted number set in a counter in the control unit 18 with a counted number based on a detected signal. When the detected counted number reaches the level of the set rotational frequency, the driving motor 35 is stopped.

Below the feed rollers 32, 34, a cartridge type cutter 50 is provided. The cutter 50 includes a fixed blade 54 and a movable blade 55 housed in a cross-sectionally rectangular box type cartridge 52. The cutter 50 is connected to a cutter motor 37 therefor, which is provided in the case 38 for the driving unit, via & driving mechanism (not shown). Owing to this arrangement, the movable blade 55 is turned to cut a paid-out portion of the rolled paper 20. The cartridge 52 is provided in upper and lower walls thereof with slits into and from which a portion of the rolled paper 20 is inserted and discharged respectively.

The cartridge 52 is provided detachably with respect to the case 38 for the driving mechanism, and with respect to the motor 37 for the cutter which drives the movable blade 55 in the case. In a fixing mechanism, a detachable lever 58 provided in the case 38 engages a locking projection 56 provided on a side surface of the cartridge 52, and the cartridge 52 is thereby held on the case 38. The detachable lever 58 is provided so that the lever 58 can be turned freely around a pivot 60, and has a the side of an operating portion 62 thereof. On the opposite side of the operating portion 62 with respect to the pivot 60, an extruding portion, 66 for forcing out the cartridge 52 when the lever is turned around pivot 60 is provided so that the extruding portion is integral with the lever.

A switch 72 for carrying out an operation for paying out the free end portion of the rolled paper 20 is provided in a lower portion on the front side of the housing 14, and a push-button 74 on the outer side of the switch 72. In the portion of the housing 14 which is on one side of the push-button 74, a knob 76 for regulating a pay-out rate of the free end portion of the rolled paper 10 like a volume regulating knob on a radio, etc. is provided.

Figure 2:
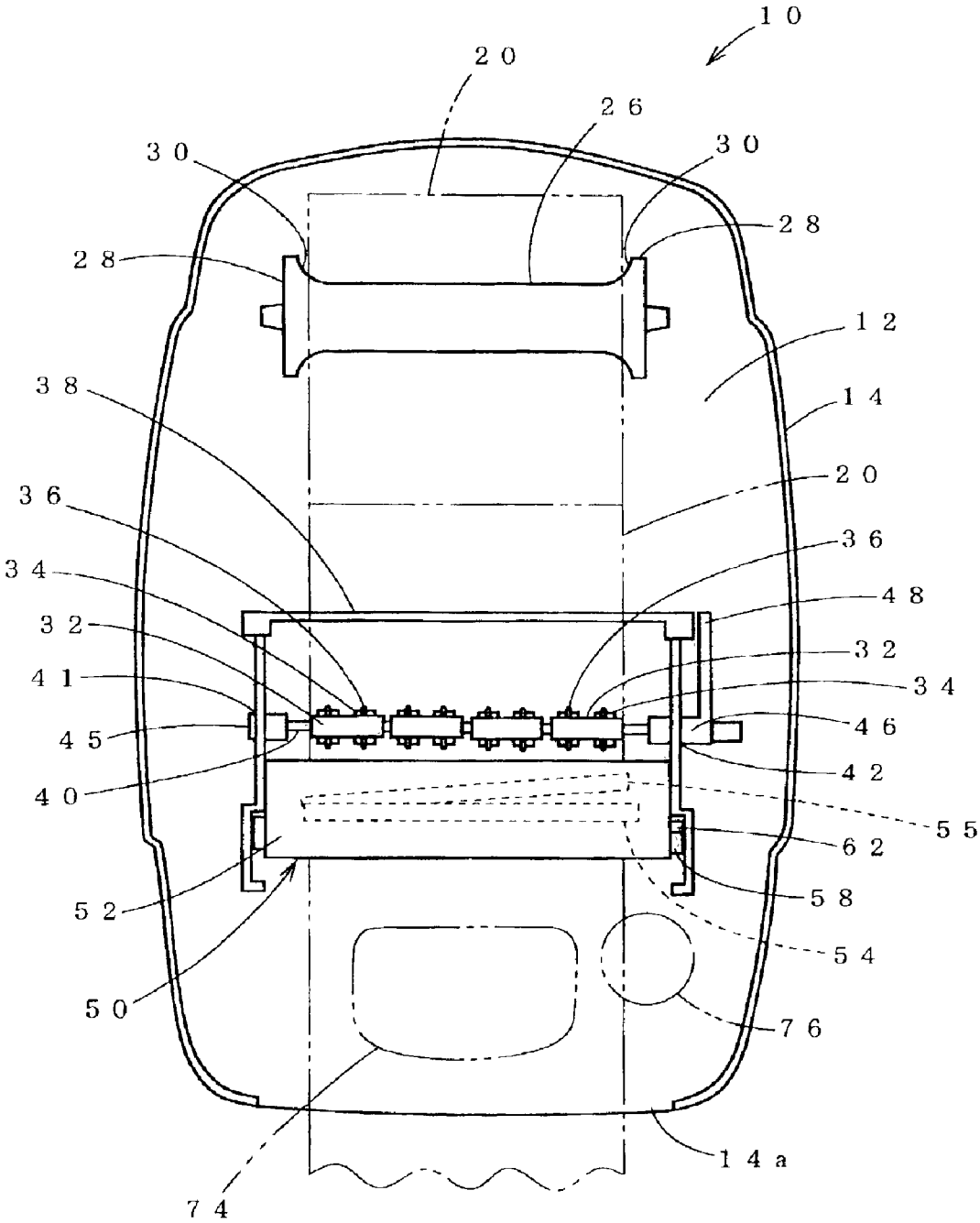
FIG. 2 is a front view of an inner portion of the mode of embodiment of the apparatus for automatically paying out a free end portion of rolled paper according to the present invention.
Figure 3:
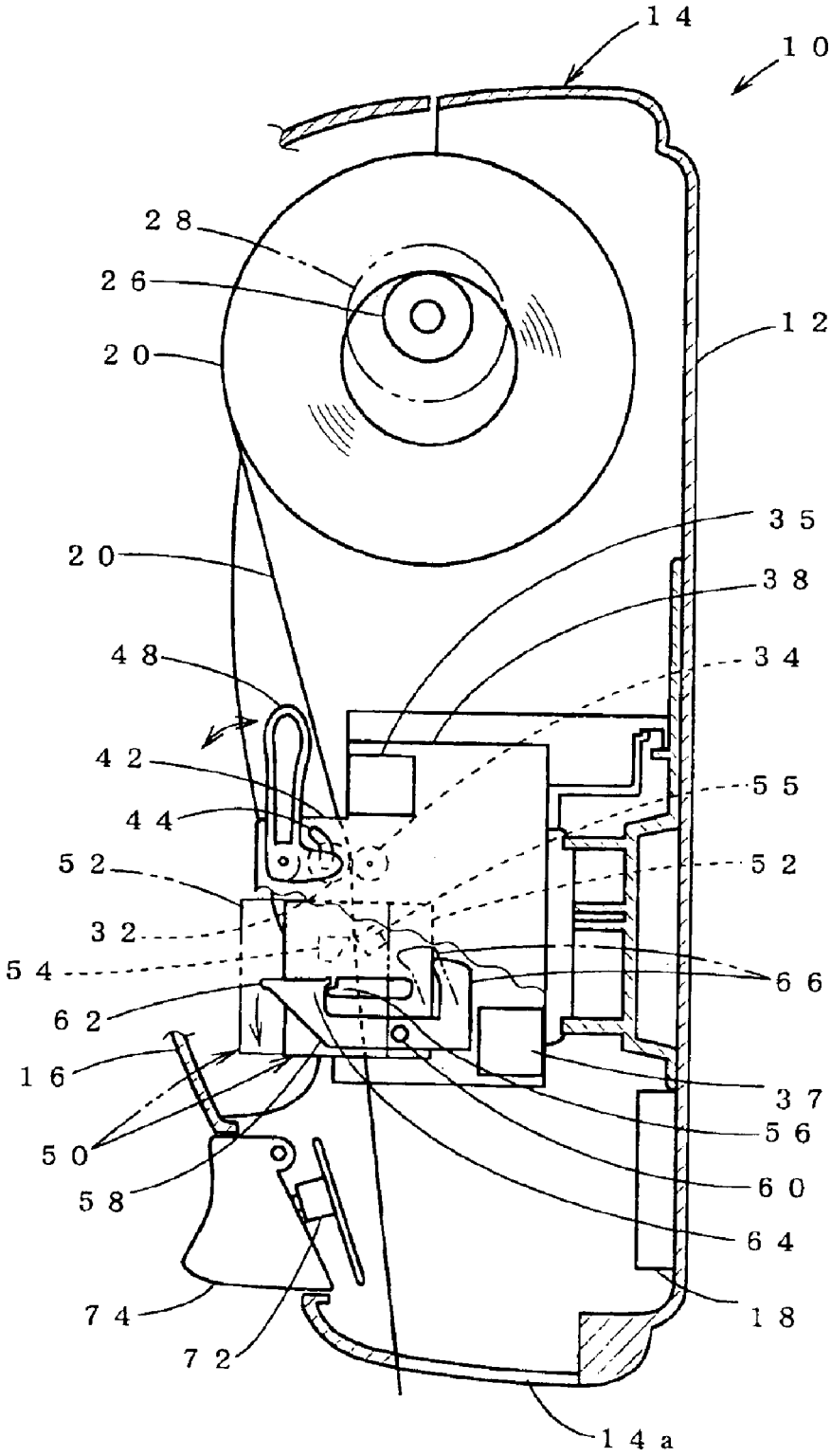
FIG. 3 is a longitudinal sectional view of the mode of embodiment of the apparatus for automatically paying out a free end portion of rolled paper according to the present invention.
Figure 4:
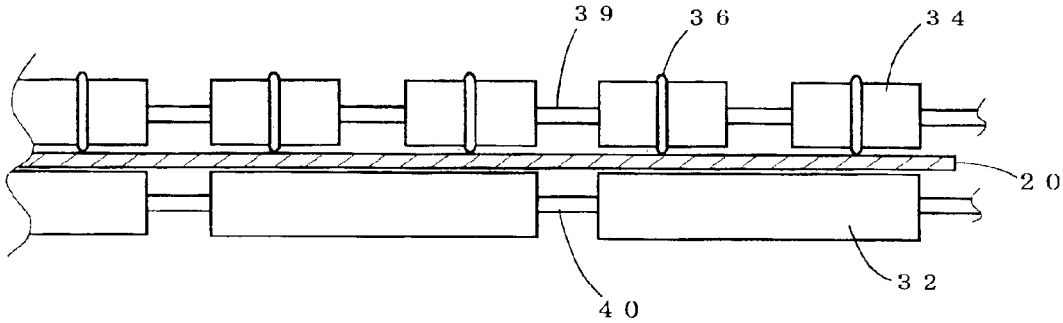
FIG. 4 is a top view of feed rollers in the mode of embodiment of the apparatus for automatically paying out a free end portion of rolled paper according to the present invention.

A method of feeding the free end portion of the rolled paper 20 for this mode of embodiment of the apparatus for automatically paying out a free end portion of rolled paper will now be described. First, the roll shaft 26 is passed through the rolled paper 20, and the resultant roll shaft 26 is set between a pair of brackets in the housing 14. A paid-out portion of the rolled paper 20 is thereafter inserted between the feed rolls 32, 34 as shown in FIGS. 2 and 3. During this time, the width of a space between the feed rolls 32, 34 is increased by turning the lever 48 forward, and the paid-out portion of the rolled paper 20 is inserted through the space. The paid-out portion of the rolled paper 20 is then passed through a slit formed in the cartridge 52 for the cutter 50, and the lever 48 is returned to its original position. In this condition, the rolled paper 20 becomes possible to be paid out at a free end portion thereof.

To use this apparatus, the push-button 74 is pressed, so that a free end portion of the rolled paper 20 is paid out at a predetermined rate owing to rotations of the rollers 32, 34. The paid-out portion of the rolled paper 20 falls on the paper receiver 22 via the opening 14*a* at a lower portion of the housing 14. When the paid-out portion of the rolled paper 20 is bent during this time due to its own weight between the joint portion 24 and the front walls 22*a* of the paper receiver 22 and contacts a side surface or side surfaces of one of the joint portion and front walls, this portion of the rolled paper is folded back in the position, and folded in the other direction, such a zigzag folding operation of this portion of the rolled paper thereafter proceeding in the same manner. The width of the folds is set by suitably regulating the positions to which the front walls 22*a* project. The pay-out rate of the free end portion of the rolled paper 20 is regulated by arbitrarily setting a set level of the control unit 18 by turning the regulating knob 76.

In a lower portion of the housing 14, a unit for spraying a medicine and the like may be set so as to automatically spray a medicine, such as a sterilizer on an upper portion of the paid-out paper 20 cut in a folded state, in accordance with a cutting completion signal. The medicine, such as a sterilizer may also be sprayed on the portion of the rolled paper 20 which is falling or being folded.

This mode of embodiment of the apparatus for automatically paying out a free end portion of rolled paper is adapted to automatically pay out the free end portion of rolled paper, such as toilet paper, kitchen paper, paper towel and the like which is drawn out continuously therefrom by the feed rollers 32, 34, to a length corresponding to that of one unit of use thereof, fold the paid-out portion of the paper, and cut the folded portion of the paper, the apparatus being capable of carrying out a series of these operations by one push-button pressing operation. Moreover, the length and width of the paid-out portion of the rolled paper 20 can be set arbitrarily, and a suitable quantity of a free end portion of the rolled paper 20 can be paid out in accordance with the purpose of using the paper. This enables the apparatus to be efficiently used. Since the inclined portions 30 are formed on both side sections of the roll shaft 26, the rolled paper 20 is always positioned on a central portion of the roll shaft 26, and the positioning of the rolled paper 20 with respect to the feed rollers 32, 34 and cutter 50 can be done automatically.

In the apparatus for paying out a free end portion of rolled paper according to this invention, the O-rings 36 are fitted as slip preventing members around the feed rollers 34. Therefore, the paid-out portion of the rolled paper 20 can be held reliably between the feed rollers 34, 32 and paid out therefrom. The replacement of the O-rings 36 is also carried out easily. Furthermore, the cutter 50 is of a cartridge type, so that the cutter can be replaced easily when it becomes dull.

The push-button 74 may be replaced with a non-contacting type member using an optical sensor or a proximity sensor besides a push type member. An audio response unit may be provided instead of the push-button. The apparatus may be set so that a plurality of folded pieces of paper be supplied automatically by one operation. In this case, it is recommended that the apparatus be set in the following manner. When a portion of rolled paper obtained after one paper-fold-cutting operation is carried out is taken up, this paper-taking operation is detected, and subsequent paper-paying-out, folding and cutting operations are carried out automatically so as to render the subsequent use of the paper possible, these operations being repeated necessary number of times automatically. This number of times shall be able to be set arbitrarily. The length to which the paper is to be folded may also be set suitably.

Owing to this arrangement, the user can obtain paper folded in a desired state, by using none of his hands. This enables a rolled paper end portion paying-out actions to be lightened for, especially, elderly persons and physically handicapped persons.

In this embodiment, a power source for the driving motor, motor for the paper cutting operations, switches, detector, control unit, etc. may be either an AC power source or a DC power source, such as a dry battery. The shape of the paper receiver can be suitably set.

The apparatus for automatically paying out a feed end portion of rolled paper according to the invention is possible for the aged, physically handicapped persons having trouble in one hand, infants, etc. to simply pay out a free end portion of rolled paper, automatically cut the paid-out portion thereof and put the cut portion thereof in a folded state, so that the paid-out portion of rolled paper can be put even in a usable state by a simple operation safely in a short period of time. Furthermore, this apparatus is sanitary for the user, capable of arbitrarily setting the width and length of a paid-out portion to be folded of rolled paper, and capable of being used in a proper condition in accordance with the purpose of use thereof. In addition, the feeding and positioning of an end portion of rolled paper are done accurately, and the reliability of the apparatus is high.

What is claimed is:

1. An apparatus for automatically paying out a free end portion of rolled paper, comprising:

a roll shaft which rotatably supports rolled paper thereon, a pair of feed rollers for continuously paying out a free end portion of the rolled paper, a driving motor for rotating the pair of feed rollers, a control unit for automatically controlling the portion of the rolled paper which has been paid out to a position beyond the pair of feed rollers, in such a manner that the paid-out portion of the rolled paper is further paid out by a length at a time corresponding to that of one unit of use thereof, a cutter for automatically cutting the portion of the rolled paper which has been paid out from the feed rollers to a length corresponding to that of one unit of use thereof, a paper receiver adapted to fold the cut portion of the rolled paper into a cross-sectionally zigzag state by utilizing the weight of the cut portion of the rolled paper, and a paper receiver width regulating unit which adjustably regulates the width to which the cut portion of the rolled paper is folded by the paper receiver, wherein the paper receiver width regulating unit includes front walls of the paper receiver which are provided forwardly slidably along movable guide members, wherein an opened portion is provided between the front walls of the paper receiver, wherein the cutter is provided in a cartridge with a pair of blades for cutting a free end portion of the rolled paper, the cartridge being detachably provided with respect to a cutter motor for actuating the pair of blades in the cartridge, wherein the roll shaft is provided with flanges, inclined portions a diameter of which varies continuously being provided between the flanges and a side surface of the roll shaft, wherein the paper receiver width regulating unit is horizontally adjustable so as to regulate the width of folded sections of the rolled paper, and wherein the cartridge is disposed under the pair of feed rollers and the cartridge is configured in the shape of a rectangular box, which includes the pair of blades, the pair of blades including a fixed blade and a movable blade therein, the movable blade being connected to the cutter motor disposed inside a case of a driving unit, the cartridge having a slit on each of an upper surface and a lower surface, through which the rolled paper passes for output, the cartridge being detachably disposed with respect to the case of the driving unit, being supported by the case with a locking projection provided on the side of the cartridge locked by a detachable lever provided in the case, the detachable lever being rotatably disposed around a pivot and a locking portion for locking the locking projection on the side of an operating portion, an extruding portion being disposed for pushing out the cartridge when the detachable lever rotates around the pivot on the side of the detachable lever opposite the operating portion.

2. An apparatus for automatically paying out a free end portion of rolled paper according to claim 1, wherein one of the two feed rollers has an O-ring fitted there around, the O-ring being brought into pressure contact with the other feed roller.

* * * * *